US005096112A

United States Patent [19]

Grigsby

[11] Patent Number: 5,096,112

[45] Date of Patent: Mar. 17, 1992

[54] INTERLOCKING PALLET FOR PAPERBOARD CONTAINER WITH ATTACHING STRIPS

[75] Inventor: John M. Grigsby, Marietta, Ga.

[73] Assignee: North American Container Corporation, Mableton, Ga.

[21] Appl. No.: 606,929

[22] Filed: Oct. 31, 1990

[51] Int. Cl.[5] ..... B65D 13/00

[52] U.S. Cl. ..... 229/23 C; 108/901; 206/599

[58] Field of Search ..... 229/23 C; 206/599, 386; 108/901

[56] References Cited

U.S. PATENT DOCUMENTS 4,171,741 10/1979 Fish ..... 229/23 C
4,832,256 5/1989 Grigsby .

FOREIGN PATENT DOCUMENTS 1265313 5/1960 France ..... 229/23 C

*Primary Examiner*—Stephen Marcus
*Assistant Examiner*—Chris McDonald
*Attorney, Agent, or Firm*—Jones, Askew & Lunsford

[57] ABSTRACT

A wood reinforced corrugated paperboard shipping container with interlocking pallet to direct positioning of the container on the pallet and to interlock the container with the pallet. The pallet includes longitudinal runners and cross members. At least one cross member overhangs the side of a lower runner. The overhang portion of the cross member and the side of the runner together define a recess which receives an attaching strip that is connected to a lowermost portion of the wall of the container. In placing the container on the pallet, a beveled upper surface on the overhang portion of the cross member bears against the bottom surface of the attaching strip. The attaching strip thereby moves downwardly and out to move around the outside end of the overhang portion of the cross member and the back into the recess, thereby matingly interlocking the container to the pallet.

13 Claims, 2 Drawing Sheets

INTERLOCKING PALLET FOR PAPERBOARD CONTAINER WITH ATTACHING STRIPS

TECHNICAL FIELD

This invention relates generally to pallets for corrugated paperboard containers, and, more particularly, to an interlocking pallet and corrugated container for packing, shipping and storing articles.

BACKGROUND OF THE INVENTION

Packaging heavy, bulky machinery such as lawn and garden tractors, lawn mowers, snow mobiles, boat motors, engines, air compressors, air conditioners and the like presents many unique considerations. Because such machinery is by nature difficult to handle and store, convention double-wall or triple-wall laminated corrugated paperboard containers have long been recognized as being unsuitable for packing heavy machinery. As a result, wood reinforced boxes with mating bases and top frames have been developed. These shipping containers are often referred to as wood cleated boxes.

The conventional wood cleated box consists of a wood reinforced corrugated paperboard body, a wooden top frame and a wooden base. At least one interior wall of the corrugated body is provided with a wood reinforcement vertically aligned to provide stacking strength. The corrugated paperboard body gives the container definition and maintains the position of the vertical wood reinforcements. The base member, often referred to as a skid or pallet, supports the container and the product packed therein. The top frame closes off the container and provides a constant surface upon which another container may be stacked. The top frame aids in distributing a top load imposed on the container; for example, a top load is imposed by a smaller package placed on top of the container in a less-than-load shipment. The arrangement of the wood cleated box seeks to prevent collapse of the container even when shipped and stored in multi-unit stacks, typically having between two to six units.

These wood cleated boxes are often handled by clamp trucks and forklifts during shipping and storing. To facilitate the use of clamp trucks and forklifts with such wood reinforced corrugated paperboard shipping containers, U.S. Pat. No. 4,832,256 discloses separate, specifically configured attaching strips on the lowermost portion of the corrugated body or container. The attaching strips are fixedly secured to the container in alignment with the sides of the base. The container is placed on the base and joined thereto. Typically, a container properly positioned on its base has a lowermost edge in a substantially horizontal plane. After the container is positioned on the base, a series of spaced-apart nails or staples are driven through the container wall, through the attaching strip and into the base to join the container and the base together. Such a container resists separation of the corrugated body from the base and can be handled by clamp trucks and forklifts. The attaching strips reinforce the lower edge of the container where the staples or nails are driven to attach the container to the base. The attaching strips are made of a material which is denser than the corrugated paperboard. This construction resists the staples from pulling through the container walls and thereby prevents separation of the container from the base.

In some instances, however, during packing of heavy equipment on an assembly line, the container is not properly positioned on the base. This leads to several problems. First, these types of wood cleated boxes are typically stacked two to six units high when held in warehouses, during shipping, and during handling. Without being fully positioned or seated down around the base, the container is not square. One corner or side is higher than the other corners or sides. As a result, the stack of wood cleated boxes leans and is unstable. A stack of wood cleated boxes which falls causes irreparable damage to the container, significant damage to the product and potential harm to bystanders. Second, staples or nails are used to join the attaching strips on the container to the base. Without being properly positioned, the container is not adequately secured to the base. Forklift or clamp truck handling of such boxes with a mis-positioned container can result in separation of the container from the base, again causing damage to the container and the contents, as well as risking potential harm to bystanders. Third, the pressure exerted by the weight of such stacked containers leads to damage of the box having an improperly seated container. For example, such pressure causes the staples used in joining the improperly seated container to the base to be bent, deformed, or broken, thus allowing the base to separate from the container.

Furthermore, some assembly lines on which these wood cleated boxes are packed use compressed air operated staplers to join the container to the base. These staplers, whether automatic or manual, may continue to operate even after the supply of staples is exhausted. Usually, the operators of such stapling machinery visually check the magazine of the stapler to insure that the supply has not been exhausted, but such visual checking may be overlooked for several cyclings of the equipment. As a result, the container is either not joined or is insufficiently joined to the base. This, of course, can also result in separation of the base and the container during handling. Such separation leads to damage of the container and the contents, as well as potential injury to bystanders.

A clamp truck handling a box with missing fasteners can also lead to damage of the container and contents and injury to persons nearby. Clamp trucks supply force to the sides of the container with hydraulically operated platens. If the base is not properly fastened to the container, the weight of the product can cause the base to fall out during clamp truck handling, risking damage to the product and bystanders.

Thus, there is a need in the prior art for a container and base that addresses the problems of joining the container to the base so that the container is seated properly on the base and the container is interlocked to the base.

SUMMARY OF THE INVENTION

The present invention solves the above-described problems with corrugated containers and support bases by providing a pallet that helps seat the container and that interlocks with the seated container. Generally described, the present invention provides a recess that receives an engaging member to matingly interlock the container and the pallet. More particularly, the present invention provides a pallet with a cross member that overhangs the side of a lower runner. The overhang portion of the cross member and the side of the runner together define a recess which receives an attaching strip that is connected to a wall of a container. The container is placed on the pallet to position the attaching strip in the recess and thereby matingly interlock the container to the pallet.

Generally described, the wood cleated box constructed in accordance with the present invention comprises a wood reinforced corrugated paperboard container and a rigid base that supports the article to be packed. An end of a cross member on the base overhangs a side of a runner on the base to define a recess. The corrugated paperboard body includes at least one attaching strip fixedly secured to a wall. The container and the base interlock by placing the container onto the base. The attaching strip aligns with the side of the base and slips around the outer edge of the end of the cross member into the recess.

Thus, it is an object of the present invention to provide an improved interlocking, wood cleated corrugated paperboard shipping container and base.

It is a further object of the present invention to provide a base which helps seat the corrugated paperboard container to the base.

It is a further object of the present invention to provide a base which matingly engages a corrugated paperboard container to form an interlocked box and thereby insure against separation of the base and the container.

It is a further object of the present invention to provide a base that interlocks with a container to assure against separation during handling.

It is a further object of the present invention to provide a base that maintains connection to the container to assure against separation in the event that a fastening machine malfunctions and fails to rigidly join the base and the container.

These and other objects, features and advantages will become apparent from a reading of the following detailed description of the invention and claims in view of the appended drawings.

DETAILED DESCRIPTION OF THE PREFERRED EMBODIMENT

Figure 1:
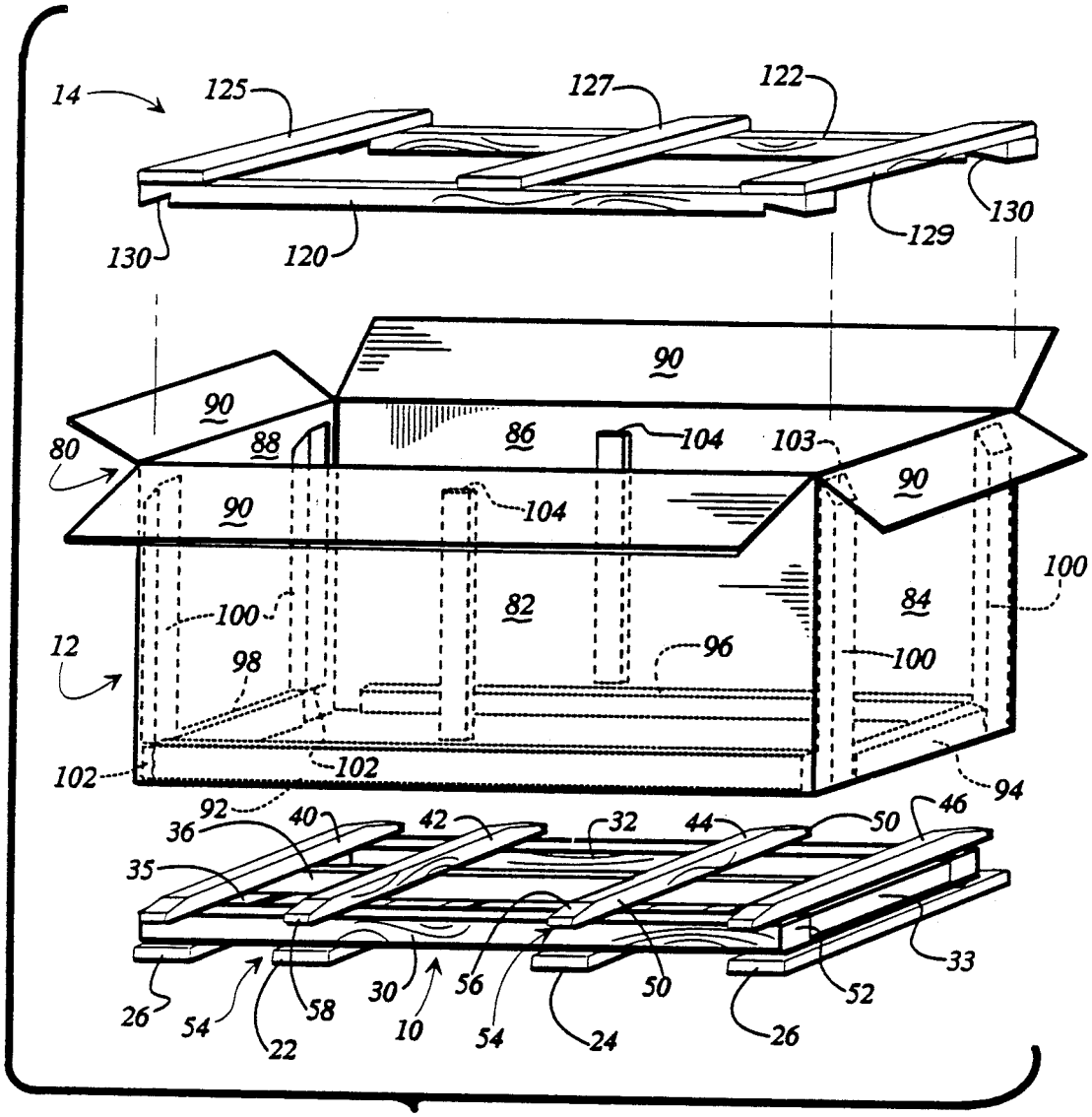
FIG. 1 is a pictorial view of an embodiment of a container and base constructed in accordance with the present invention.

Referring now in more detail to the drawings, in which like numerals indicate like parts throughout the several views, FIG. 1 shows a preferred embodiment of a base 10 that interlocks with a reinforced corrugated paperboard shipping container 12 having attaching strips according to the present invention. A top frame 14 is illustrated above the corrugated container 12.

The base 10 is a rigid pallet adapted to hold articles to be packaged, stored and shipped in the container 12. In the embodiment illustrated in FIG. 1, the base 10 consists of wood floor boards, runners, end pieces, and cross members. A plurality of floor boards 20, 22, 24 and 26 are parallel and spaced-apart. Each floor board extends the entire width of the base 10. Two runners 30 and 32 are disposed substantially perpendicular to the floor boards 20–26 and extend the length of the base. The runners 30 and 32 are made of wood or other dense material and are fastened or otherwise secured to the floor boards 20–26 by nails, staples or other suitable fasteners, glue or other suitable means. The end pieces 33 and 35 are disposed longitudinally on the floor boards 20 and 26, respectively, and are fastened in a similar manner to the floor boards. It should be noted that the runners 30 and 32 and the end pieces 33 and 35 are set off from the outside corner of the floor boards 20 and 26. In an alternate embodiment, the end piece 33 comprises two spaced-apart blocks (best shown in FIG. 3 discussed below). This permits entry of the blades of a fork lift truck into the base. However, the thickness of the floor boards 20–26 may be sufficient to define an entry space for the blades of a fork lift truck. The thickness of fork lift blades is generally between 1¼ inches and 2 inches. For boxes handled only by clamp truck, the floor boards are about ½ inch thick.

The base 10 further consists of at least one center reinforcing runner 36 that extends the length of the base 10 and is fastened to the floor boards 20–26, as discussed above, to give stability to the base 10. In an alternate embodiment (not illustrated), the base 10 has two spaced-apart center runners. This provides added strength to the base for handling. In the embodiment having the two end blocks, the pair of center runners 36 guide the positioning of the blades in the base.

Figure 2:
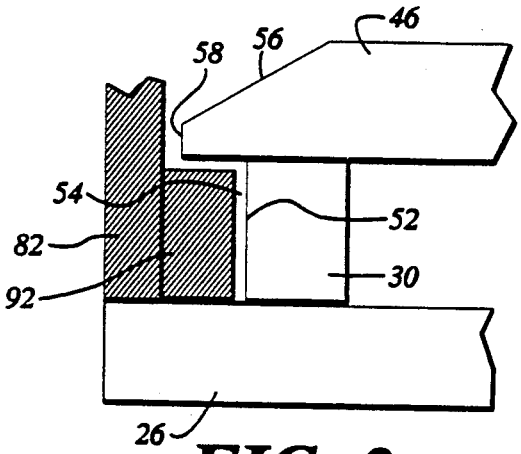
FIG. 2 is a section view of the embodiment shown in FIG. 1.

Secured to an upper surface of the runners 30, 32 and 36 are four spaced-apart cross members 40, 42, 44 and 46. The cross members 40–46 extend between the runners 30 and 32. The cross members 40–46 in the illustrated embodiment are parallel and are disposed substantially perpendicular to the longitudinal axis of the runners 30 and 32. Each cross member 40–46 has a pair of longitudinally spaced distal ends 50. With reference to FIG. 2, each of the ends 50 extends as an overhanging ledge laterally from an edge defined by an outside face 52 of the respective runners 30 and 32. The overhanging ends 50 and the outside faces 52 define a plurality of recesses 54 on the sides of the base 10. The ends 50 in the illustrated embodiment are beveled on an upper surface 56 to taper downwardly towards an outside end 58 of each of the cross members 40–46.

The container 12 in the illustrated embodiment is a corrugated paperboard body formed by a blank 80 of corrugated paperboard material. The blank 80 includes four main panels 82, 84, 86 and 88 foldably connected along score lines. The four main panels 82, 84, 86 and 88 form the four walls of the container 12 as shown in FIG. 1. A manufacturers joint is foldably connected to one of the main panels. The function of the joint is well known to those skilled in the art and is otherwise outside the scope of the present invention. In the illustrated embodiment, a series of four top flaps generally designated 90 are foldably connected to the main panels. Each main panel 82, 84, 86 and 88 is provided with an attaching strips 92, 94, 96 and 98, respectively, at its lowermost portion. Each one of the attaching strips 92–98 is made of a dense material with sufficient strength to prevent or resist nails or staples being pulled through the material. Each attaching strip extends substantially the length of its respective main panel. The attaching strips 92–98 are fixedly secured to the inside surface of the main panels preferably by both staples and adhesive. However, any suitable means of attaching is acceptable.

The main panels 84 and 88 of the blank 80 are each provided with a pair of vertical corner reinforcements 100. The vertical reinforcements 100 are made of wood or other material of sufficient strength and stiffness to support a vertical stacking or top load force. The reinforcements 100 extend substantially the height of their respective main panels 84 and 88. The lowermost edge of the vertical reinforcements 100 sit near the very bottom of the respective main panels 84 and 88. The bottom portion of each vertical reinforcement 100 is notched as generally indicated at 102. An uppermost portion 103 of each corner vertical reinforcement 100 is beveled such that the outer portion of the reinforcement is of greater height then the inner most portion of the reinforcement.

The main panels 82 and 86 are each provided with at least one reinforcing member 104 which is made of the same materials as the vertical reinforcements 100. The reinforcing member 104 extends substantially the height of its respective main panel. Each reinforcement 104 extends no lower than the attaching strip 92 and 96 and extends no higher than the innermost edge of the top surface of the vertical corner reinforcement 100.

The top frame 14 in the illustrated embodiment consists of two members 120 and 122 that run lengthwise of the container 12. Secured to the top of the two lengthwise pieces 120 and 122 are three cross pieces 125, 127 and 129. These elements 120, 122, 125, 127 and 129 are usually made of wood and may be secured in this arrangement by nails, staples, or other suitable connectors. The top frame 14 is dimensioned to sit in the uppermost portion of the corrugated paperboard body 12. The ends of the lengthwise members 120 and 122 are each formed with notches generally designated 130. The notches 130 are beveled to facilitate receipt of the top frame 14 on the upper portions 103 of the corner reinforcements 100 on the corrugated paperboard body 12.

In the practice of the present invention, the blank 80 of corrugated paperboard is laid flat. The attaching strips 92, 94, 96 and 98 are fully glued and stapled to the main panels 82, 84, 86 and 88, respectively. A preferred adhesive is polyvinyl alcohol (PVA) and any suitable adhesive may be used. The preferred staples are ¾ inch to one inch crown and have a leg length equal to approximately the thickness of the attaching strips 92, 94, 96 and 98 plus a thickness of the blank 80. It is furthermore preferred that the staples be spaced-apart a distance of approximately four inches and angled at 45° to achieve maximum contact of the corrugated paperboard main panels 82, 84, 86 and 88 to its respective attaching strip. While it is preferred that the attaching strips 92, 94, 96 and 98 be located along the bottom edges of the interior of the main panels, the attaching strips may be secured to the exterior surfaces of the main panels in an alternate embodiment illustrated in FIG. 3. In this embodiment, an opening 134 is formed in the paperboard walls 82 and 86 immediately above the upper surface of the attaching strips 92 and 96. The position of the opening 134 in the paperboard wall corresponds to the position of the outside end 58 of the cross members 40, 42, 44 and 46 when the container 12 is seated on the base 10. In this embodiment, the staples joining the container 12 to the base 10 effectively squeeze the corrugated board between the attaching strips and the base. This may be of an advantage when the weight of the linerboard in the corrugated paperboard container is light and does not provide an adequate glue bond surface for the attaching strip to be placed on the inside. The openings 134 are sized to receive the outside end 58 of the cross members 40–46. The cross members are long enough to protrude through the openings 134 so that the beveled end portion can overlap the attaching strip 92 and 96 on the outside surface of the respective main panel 82 and 86.

In a similar manner, the vertical corner reinforcements 100 are attached to the main panel 84 and 88. The notches 102 in each corner vertical reinforcement 100 are aligned with their respective attaching strips 94 and 98 on the main panels 84 and 88, respectively. Additionally, the center reinforcements 104 are glued and stapled to their respective main panels 82 and 86.

Once the corrugated paperboard body 12 is formed, it is placed over the base 10. In placing the container 12 over the base 10, a bottom surface of the attaching strips 92 and 96 is pushed against the beveled surface 56 of the cross members 40, 42, 44 and 46. The main panels 82 and 86 are pushed outwardly by the downward bevel to allow the attaching strips 92 and 96 to slide around the ends of the cross members 40, 42, 44 and 46 and thereby move into the recess 54. The attaching strips 92 and 96 thus sit flush against the runners 30 and 32 while the attaching strips 94 and 98 sit flush against the end pieces 33 and 35. The notches 102 in the bottom portions of the vertical corner reinforcements 100 are positioned such that the notched surface sits flush against one of the end pieces 33 and 35. The bottom of the center reinforcement 104 sits on the upper surface of the cross member 42 or 44. As discussed above, the ends 50 of the cross members 40–46 are beveled. For the end cross members 40–46, the bevel is preferably at a 45° angle to the longitudinal axis of the cross member. The bevel preferably begins in the upper surface of the cross member at a line defined by the longitudinal axis of the runner below the cross member. For the inner cross members 42 and 44, the bevel angle is greater than 45° to accommodate a flat area on the upper surface of the cross member on which the bottom of the vertical cleat 104 rests.

It will be appreciated that the thickness of the attaching strips 92, 94, 96 and 98 must not be greater than half the thickness of the vertical corner reinforcements 100. The outermost portion of the attaching strips 92, 94, 96 and 98 is to be in alignment with the outermost portion of the notched surface in the vertical reinforcements 100. When the corrugated paperboard body 12 is thus fit about the base 10, the attaching strips may be joined by nails or staples to the runners 30 and 32 and the end pieces 33 and 35 in the notched portion of the vertical corner reinforcements 100. The top frame 14 is configured to fit inside the upper dimensions of the corrugated paperboard body 12. The notches 130 of the lengthwise wood pieces 120 and 122 are positioned to fit over the beveled surfaces at the top of the corner vertical reinforcements 100. This arrangement serves to lock the top frame 14 into the corner vertical reinforcements 100. The cross pieces 125, 127 and 129 are appropriately positioned to clear and to protect any heavy package machinery.

It will be appreciated that the above-described invention provides a significant advantage over prior art containers. The upper surfaces 56 of the cross members direct the positioning of the container 12 on the base 10. The beveling on the upper surface 56 further facilitates such positioning. Each of the attaching strips 92 and 96 is directed around the respective ends 58 of the cross members 42, 44, 46 and 48 and into the recess 54. In the illustrated embodiment, the main panels 82 and 86 are moved outwardly as the lower surface of the attaching strips 92 and 96 slide on the beveled upper surface 56 of the cross members. As the attaching strips move into the recess 54, the main panels 82 and 86 move laterally back toward the base 10. The attaching strips 92 and 96 are thus held in the recesses 54, thereby interlocking the container 12 to the base 10. This insures connection of the respective component parts and prevents separation of the base 10 from the container 12 under normal conditions of packing and handling. Further, in the event that a staple gun misoperates, or runs out of staples without notice, the interlock of the pallet to the container restricts separation of these component parts during handling, packing and shipping of equipment.

Figure 4:
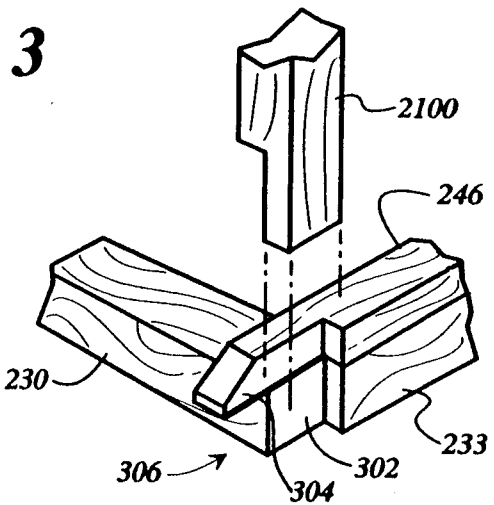
FIG. 4 is a section view of the embodiment shown in FIG. 3.
Figure 3:
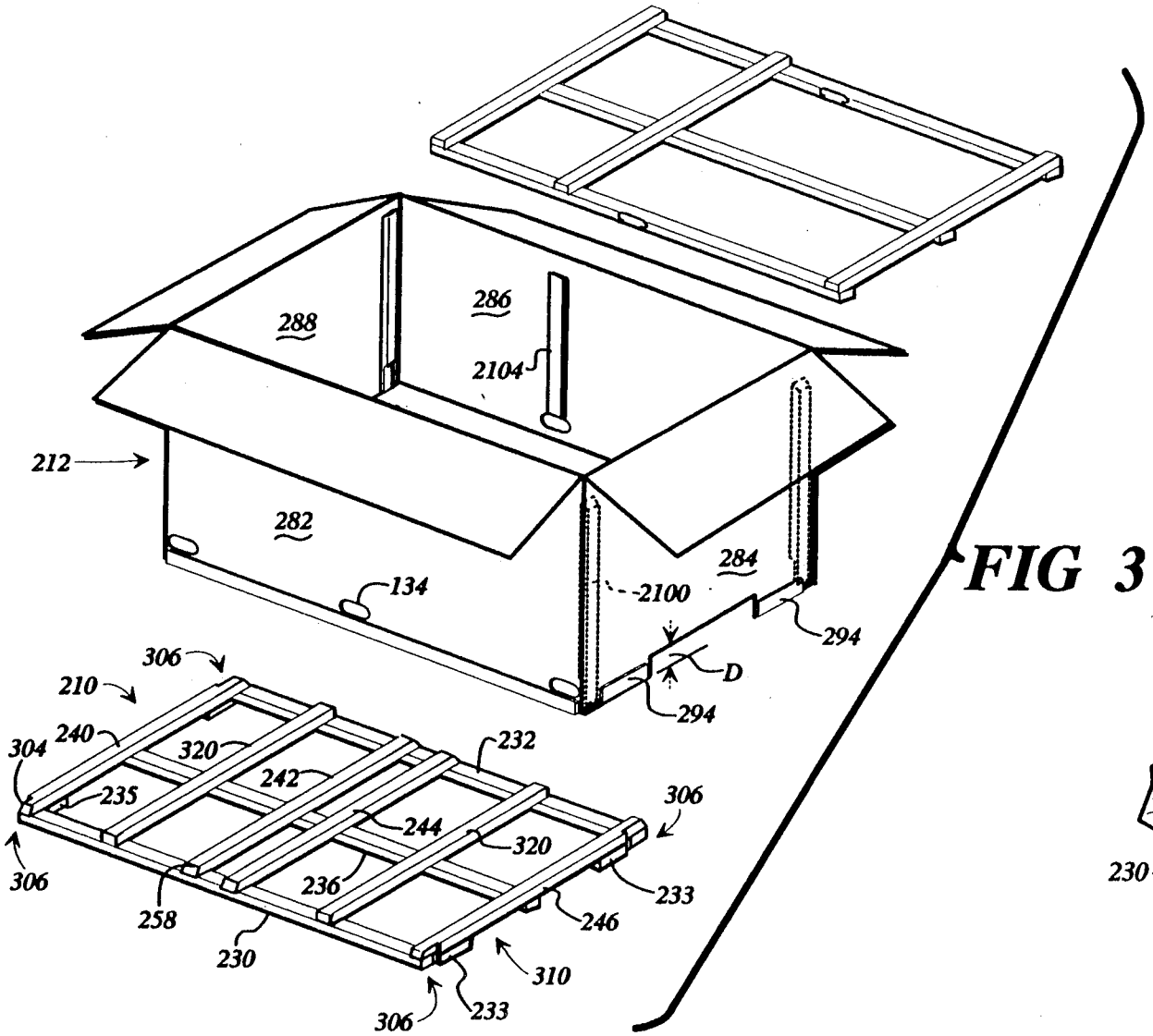
FIG. 3 is a pictorial view of an alternate embodiment of a container and interlocking base constructed in accordance with the present invention.

FIGS. 3 and 4 further illustrate alternate embodiments of the base and the container. For convenience, the elements identified with a prefix "2" correspond to the elements identified above. In an alternate embodiment, the container 212 includes a series of seats which are spaced apart in the main panels 82 and 86 of the container. Each seat is an opening 134 which receives one end 258 of one of the cross members 240–246 when the container 212 is placed over the pallet 10. The attaching strips 292–298 are illustrated on the exterior surface of the main panels, but may be on the interior surface. The lower surface of the cross members 240–246 is next to the upper surface of the attaching strips 292–296 (not shown).

In another alternate embodiment for lighter weight items, the container includes the seats 134 but does not include the horizontal attaching strips 292–298. The container 212 and the base 210 are connected by inserting the ends 258 of the cross members 240–246 through the seats 134 in the main panels 282 and 286. In a preferred embodiment, the base 210 does not include the floor boards 20–26. Rather, the base 210 consists of the runners 230, 232 and 236, the end blocks 233 and 235, and the cross members 240–246. As illustrated, the base 210 is strengthened by using a pair of cross members 320 which extend between the outside runners 230 and 232 but do not overhang the outside edge of the runners. In this embodiment, the end blocks 233 and 235 extend inwardly perpendicular from the longitudinal ends of the outside runners 230 and 232. The end blocks are offset slightly from the ends of the runners, and thereby cooperate with the ends to define an L-shape notch 302, the purpose of which is discussed below. The end blocks 233 are spaced-apart, as are the end blocks 235, to define a gap 310 at each end of the base 210 for receiving therethrough the blades of a fork lift truck, as discussed above.

The cross members 240 and 246 each include L-shaped notches 304 at their respective longitudinal ends. The notches 302 and 304 cooperate to define a socket 306 which receives the tennon portion of the vertical cleat 2100 of the container 212. As may be appreciated by those of ordinary skill in the art, the end panels 284 and 288 of the corrugated container 212 include a notched portion along the bottom edge corresponding to the gaps 310 defined by the spaced-apart end blocks 233 and 235. The height D of the notch is equal to or slightly greater than the height of the runners 230, 232 and 236. The length of the attaching strips 294 and 298 match the length of the end blocks 233 and 235. The assembly and use of the alternate embodiment illustrated in FIGS. 3 and 4 is like that discussed above. It should be noted that the tennon of the vertical cleat 2100 is received by the respective socket 306 when the container 212 is positioned on the base 210. A nail or staple is placed through the tennon into the runner 230 (or 232) of the base 210 to further rigidly join the base and the container. The bottom of the center reinforcement 2104 sits on the upper surface of the cross member 244.

This specification has thus described various embodiments, including a preferred embodiment, of the present invention, and including the steps necessary for fabricating such embodiments. It is to be understood, however, that numerous changes and variations may be made in the construction of the present interlocking container within the spirit of the present invention. It should therefore be further understood that modifications of the present invention may be made without departing from the scope thereof as set forth in the appended claims.

What is claimed is:

1. An improved pallet for a paperboard container comprising a wall forming blank of paperboard scored to provide a series of main panels foldably joined together at a plurality of corners and at least one substantially horizontal attaching strip fixedly secured to a wall surface of one of said main panels, comprising:

at least two spaced-apart runners; and at least two spaced-apart cross members extending between said runners and connected thereto on an upper surface of said runners, at least one cross member having an end portion which extends laterally as a ledge from an outside edge of one of said runners to define a recess, said end portion has a bevel on an upper surface of said member, said attaching strip matingly engaged in said recess when said paperboard container is positioned on said pallet.

2. The improved pallet as recited in claim 1, wherein said end portion extends outwardly a distance equal to a width of said horizontal attaching strip.

3. The improved pallet as recited in claim 1, further comprising at least two spaced-apart floor boards extending between said runners and connected thereto on a lower surface of each of said runners.

4. The improved pallet as recited in claim 3, wherein each of said floor boards each have longitudinally spaced distal ends which extend laterally out from said outside edge of said one runner.

5. The improved pallet as recited in claim 4, wherein each said distal end of said floor boards extends outwardly a distance equal to the sum of a width of said attaching strip and a thickness of said paperboard blank.

6. The improved pallet as recited in claim 4, wherein each said distal end of said floor boards extends outwardly a distance equal to the sum of a width of said attaching strip and a thickness of said paperboard blank.

7. The improved pallet as recited in claim 1, wherein said bevel tapers downwardly from a line defined by a longitudinal axis of said one runner.

8. A container and interlocking base, comprising:

a paperboard container comprising a wall forming blank of paperboard scored to provide a series of main panels foldably joined together at a plurality of corners; at least two spaced-apart seats in each of two main panels; and a base which interlocks with said paperboard container, comprising:

at least two spaced-apart runners; and at least two spaced-apart cross members extending between said runners and connected thereto on an upper surface of each of said runners, said cross members having longitudinally spaced distal end portions, each end portion extending laterally as a ledge from an outside edge of one of said runners to define a recess, whereby said paperboard container is positioned on said base by lowering thereon so that each of said distal end portions matingly engages one of said seats.

9. The container and interlocking base as recited in claim 8, further comprising an attaching strip fixedly secured to at least one of said main panels and aligned with said seats whereby an upper surface of said attaching strip is next to a lower surface of said cross member when engaged in said seat.

10. The container and interlocking base as recited in claim 9, wherein said attaching strip is secured to an inner wall surface of said main panel and said end portion has a bevel on an upper surface of said cross member.

11. The container and interlocking base as recited in claim 10, wherein said end portion has a bevel on an upper surface of said cross member, whereby said moving of said portion results partially from contacts between a lower surface of said attaching strips and said bevel surfaces.

12. A paperboard container and base, comprising:

a paperboard body comprising a wall forming blank of paperboard scored to provide a series of main panels foldably joined together at a plurality of corners;

an attaching strip fixedly secured to a portion of each of two opposing main panels; and a base which interlocks with said paperboard container, comprising:

at least two spaced-apart runners; and at least two spaced-apart cross members extending between said runners and connected thereto on an upper surface of each of said runners, said cross members having longitudinally spaced distal end portions, each end portion extending laterally as a ledge from an outside edge of one of said runners to define a recess, whereby said paperboard body is positioned on said base by lowering thereon and moving said portion of said main panels outwardly an amount sufficient to allow the attaching strips to move around and past the end portions and releasing said main panels to move inwardly, thereby moving said attaching strips into said recesses.

13. A method of interlocking a paperboard body and a base, comprising:

forming a joined paperboard body into a joined tube, said paperboard body comprising a wall forming blank of paperboard scored to provide a series of main panels foldably joined together at a plurality of corners with an attaching strip fixedly secured to a lower portion of each of two opposing main panels; and positioning said tube over a base, said base comprising at least two spaced-apart runners and at least two spaced-apart cross members extending between said runners and connected thereto on an upper surface of each of said runners, said cross members having longitudinally spaced distal end portions, each end portion having a bevel on an upper surface and extending laterally as a ledge from an outside edge of one of said runners to define a recess, whereby the contacts between a lower surface of said attaching strips and said bevelled upper surface of said end portions pushes said main panels outwardly to allow the attaching strips to move around and past the end portions and thereby move said attaching strips into said recesses.

* * * * *